US008519870B1

(12) United States Patent
Peterson

(10) Patent No.: US 8,519,870 B1
(45) Date of Patent: Aug. 27, 2013

(54) INDICIA FOR PROVIDING A VISUAL CLUE OF THE POSITION OF A VEHICLE ON A RACE TRACK

(76) Inventor: Robin A. Peterson, Port Orange, FL (US)

( * ) Notice: Subject to any disclaimer, the term of this patent is extended or adjusted under 35 U.S.C. 154(b) by 140 days.

(21) Appl. No.: 13/334,342

(22) Filed: Dec. 22, 2011

Related U.S. Application Data

(60) Provisional application No. 61/426,803, filed on Dec. 23, 2010.

(51) Int. Cl.
*G08G 1/123* (2006.01)

(52) U.S. Cl.
USPC ..... 340/995.1; 340/331; 340/332; 40/594; 40/612

(58) Field of Classification Search
USPC ..... 340/995.1, 323 R, 321, 331, 332; 40/546, 557, 558, 565, 594, 606.12, 612; 362/559, 812
See application file for complete search history.

(56) References Cited

U.S. PATENT DOCUMENTS

| | | | | |
|---|---|---|---|---|
| 4,880,083 | A * | 11/1989 | Thompson | 188/2 R |
| 5,441,784 | A * | 8/1995 | Smith | 40/594 |
| 6,467,632 | B1 * | 10/2002 | Guillot | 211/13.1 |
| 7,033,103 | B2 * | 4/2006 | Gort | 40/612 |
| 7,688,222 | B2 * | 3/2010 | Peddie et al. | 340/332 |

* cited by examiner

*Primary Examiner* — John A Tweel, Jr.
(74) *Attorney, Agent, or Firm* — Donald J. Ersler

(57) ABSTRACT

Indicia for providing a visual clue of the position of a vehicle on a race track preferably includes at least one of a first wall indicia strip and a first shoulder indicia strip being formed around the entire race track. At least one of a second wall indicia strip and a second shoulder indicia strip are formed starting at the beginning of the second turn and ending at the start/finish line. At least one of a third wall indicia strip and a third shoulder indicia strip are formed starting at substantially the half way point of the second straight and ending at the start finish line. At least one of a fourth wall indicia strip and a fourth shoulder indicia strap are formed starting at the beginning of the fourth turn and ending at the stop/finish line.

18 Claims, 6 Drawing Sheets

INDICIA FOR PROVIDING A VISUAL CLUE OF THE POSITION OF A VEHICLE ON A RACE TRACK

CROSS-REFERENCES TO RELATED APPLICATIONS

This is a utility patent application taking priority from provisional application No. 61/426,803 filed on Dec. 23, 2010.

BACKGROUND OF THE INVENTION

1. Field of the Invention

The present invention relates to race tracks and more specifically to indicia for providing a visual clue of the position of a vehicle on a race track, which allows a viewer of a race to determine the position of a vehicle on the race track.

2. Discussion of the Prior Art

It appears that the prior art fails to disclose indicia for providing a visual clue of the position of a vehicle on a race track. The closest prior art appears to be yard marker lines drawn on a football field.

Accordingly, there is a clearly felt need in the art for indicia for providing a visual clue of the position of a vehicle on a race track, which allows a viewer of a race to determine the position of a vehicle on the race track by the indicia formed on the race track; shows a vehicle at speed, whereas the indicia is not lost or blurred during a visual broadcast; and enhances a spectator's viewing experience.

SUMMARY OF THE INVENTION

The present invention provides indicia for providing a visual clue of the position of a vehicle on a race track, which shows a vehicle at speed, whereas the indicia is not lost or blurred during a visual broadcast. An oval type race track includes a first straight, a first turn, a second turn, a second straight, a third turn and a fourth turn. The first straight is divided by a start/finish line. The indicia for providing a visual clue of the position of a vehicle on a race track (race track indicia) preferably includes at least one of a first wall indicia strip and a first shoulder indicia strip formed around the periphery of the race track.

At least one of a second wall indicia strip and a second shoulder indicia strip are formed starting at the beginning of the second turn and ending at the start/finish line. At least one of a third wall indicia strip and a third shoulder indicia strip are formed starting at substantially the half way point of the second straight and ending at the start finish line. At least one of a fourth wall indicia strip and a fourth shoulder indicia strip are formed starting at the beginning of the fourth turn and ending at the stop/finish line.

Each indicia strip may be a solid line, a dashed line, a plurality of objects or any other suitable graphical representation. If the indicia strip is physically applied to the infield shoulder, the strip may have to be made discontinuous for pit entrances and exits. Each indicia strip may also be digitally added to a video feed of the race.

Accordingly, it is an object of the present invention to provide indicia for providing a visual clue of the position of a vehicle on a race track, which allows a viewer of a race to determine the position of a vehicle on the race track by the indicia formed on the race track.

It is another object of the present invention to provide indicia for providing a visual clue of the position of a vehicle on a race track, which enhances a spectator's viewing experience.

It is finally an object of the present invention to provide indicia for providing a visual clue of the position of a vehicle on a race track, which shows a vehicle at speed, whereas the indicia is not lost or blurred during a visual broadcast.

These and additional objects, advantages, features and benefits of the present invention will become apparent from the following specification.

DETAILED DESCRIPTION OF THE PREFERRED EMBODIMENTS

Figure 1:
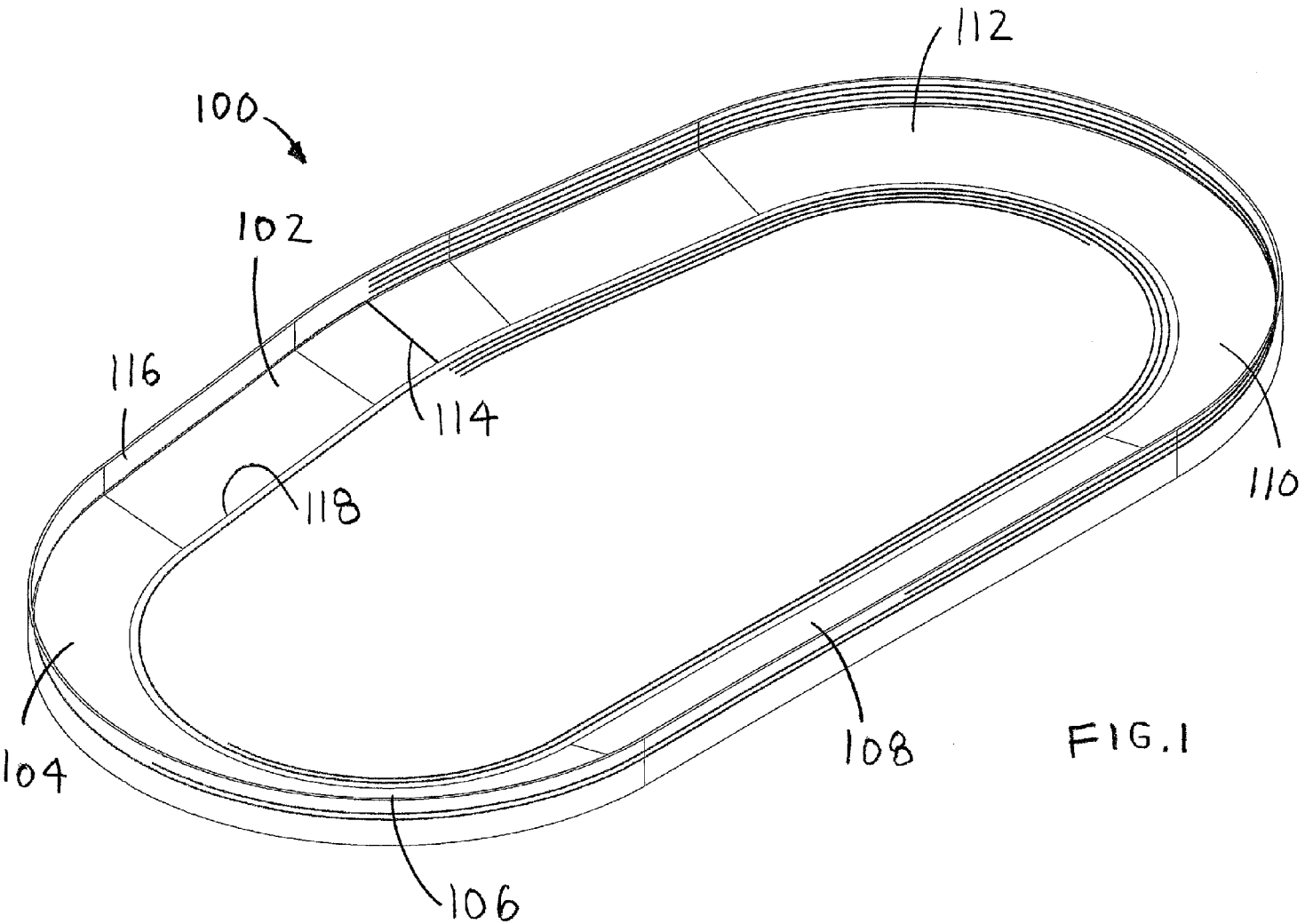
FIG. 1 is a top perspective view of a race track with indicia formed thereupon in accordance with the present invention.
Figure 2:
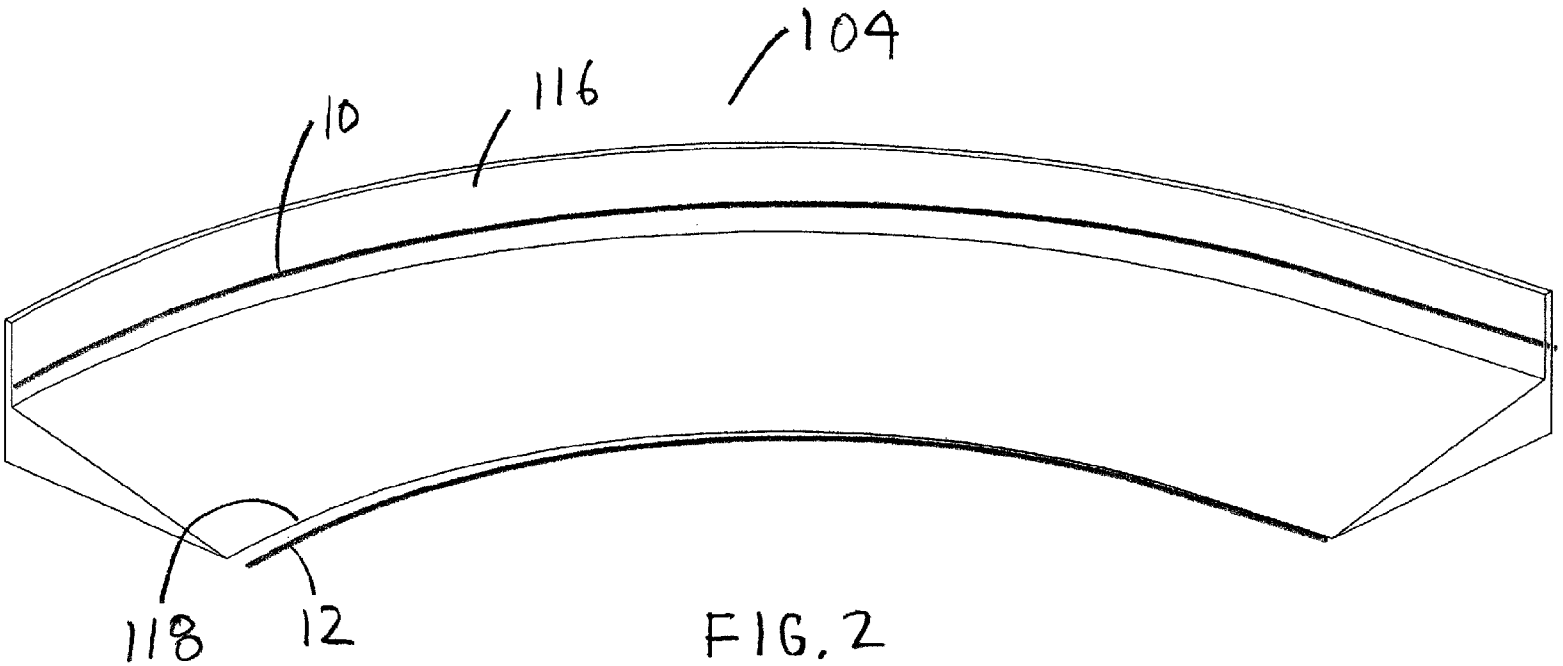
FIG. 2 is a top perspective view of a first turn of a race track with indicia formed thereupon in accordance with the present invention.
Figure 3:
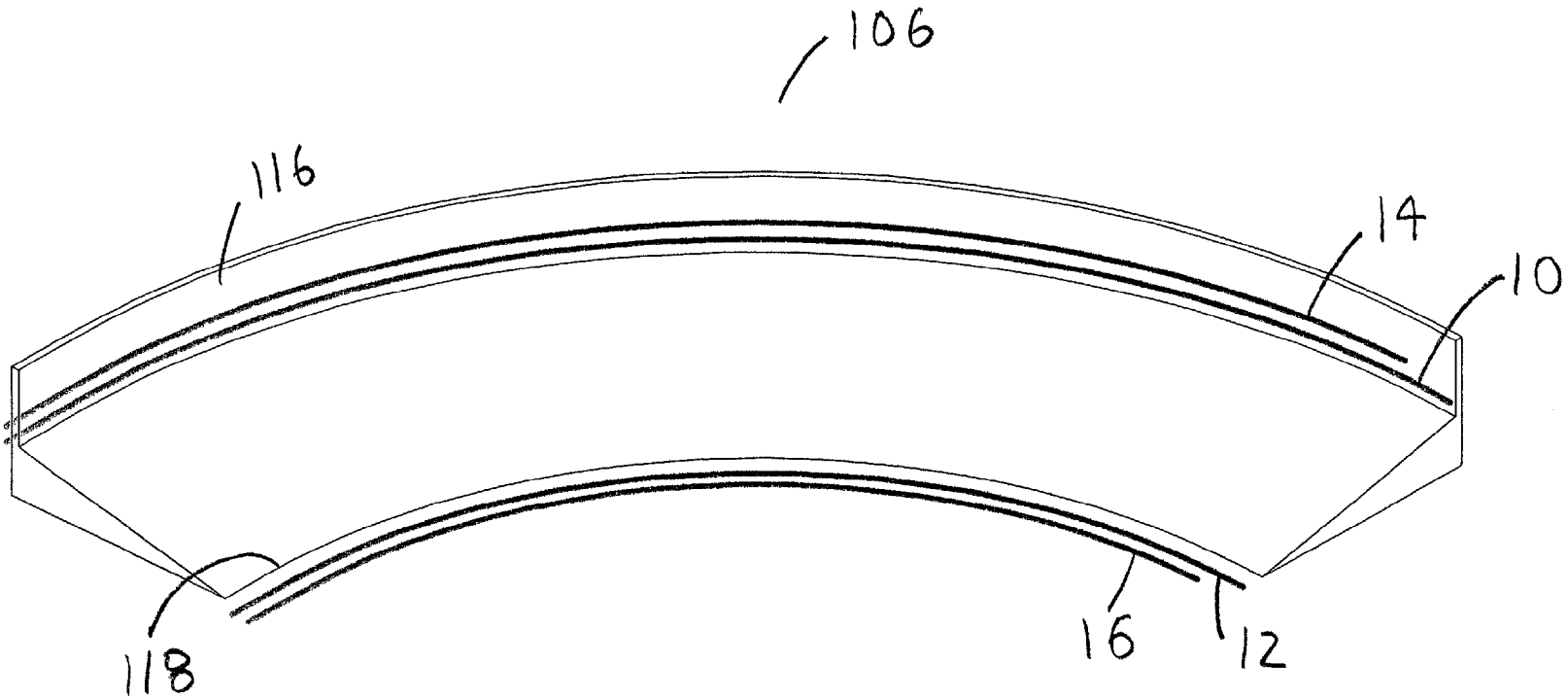
FIG. 3 is a top perspective view of a second turn of a race track with indicia formed thereupon in accordance with the present invention.
Figure 4:
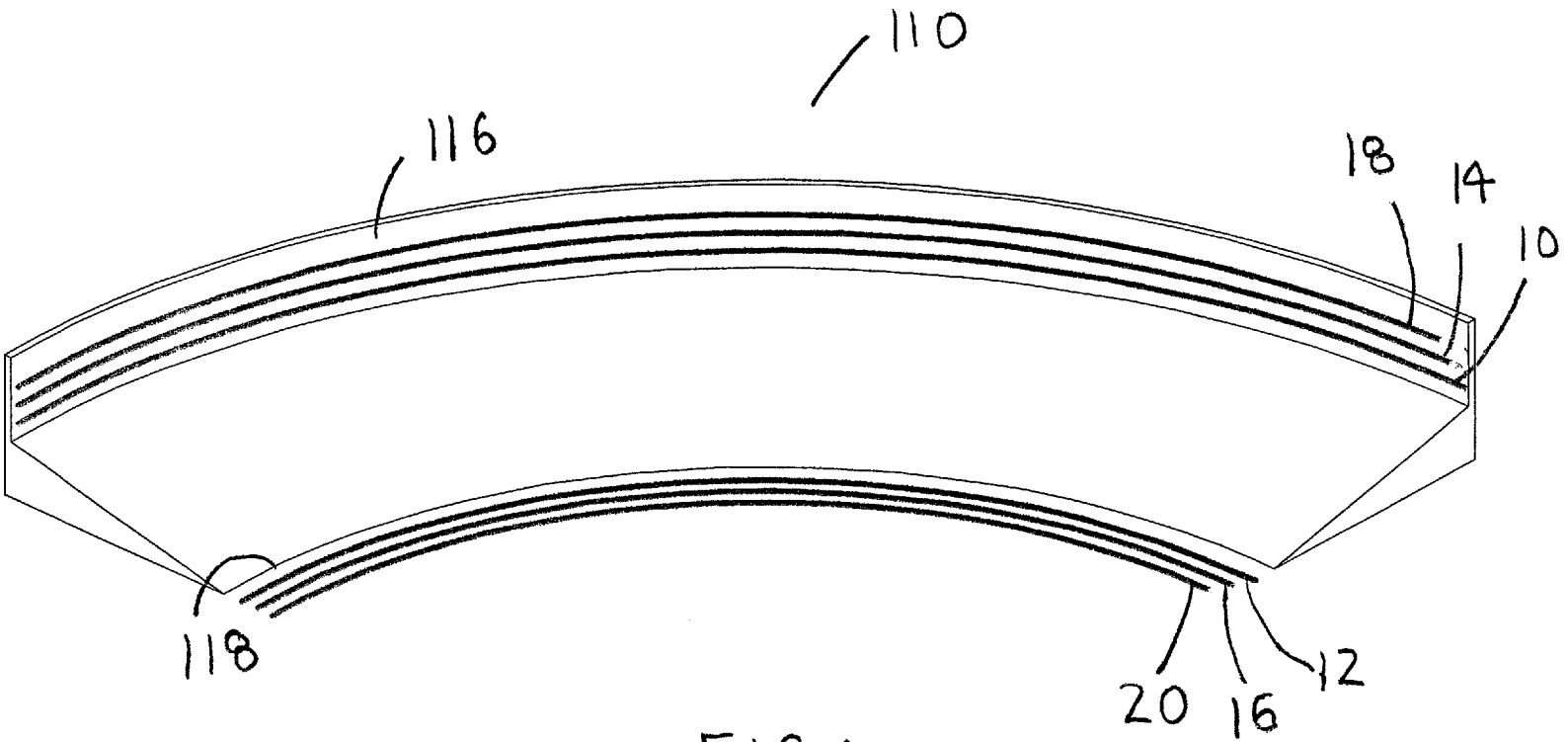
FIG. 4 is a top perspective view of a third turn of a race track with indicia formed thereupon in accordance with the present invention.
Figure 5:
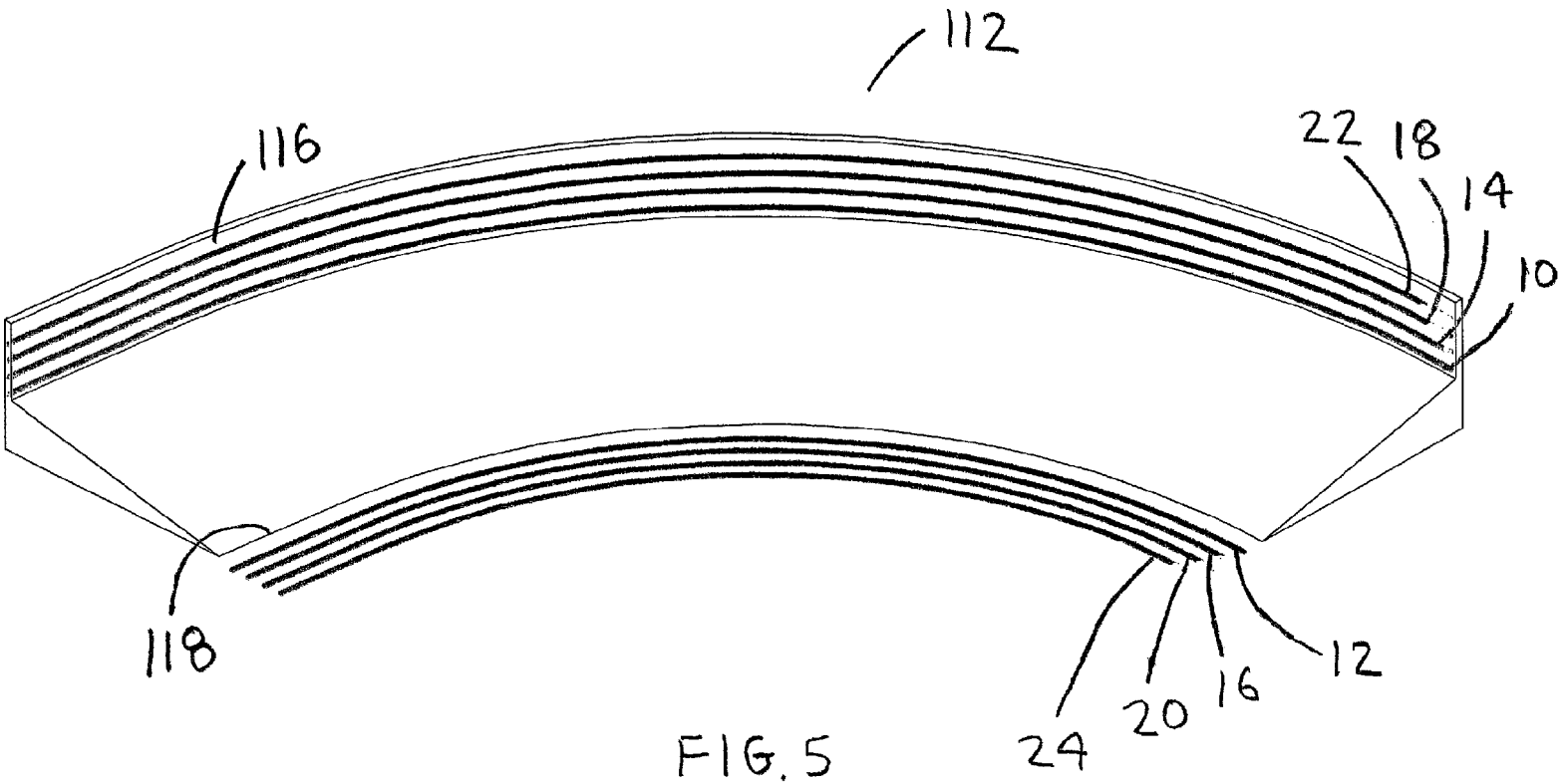
FIG. 5 is a top perspective view of a fourth turn of a race track with indicia formed thereupon in accordance with the present invention.

With reference now to the drawings, and particularly to FIG. 1, there is shown a top perspective view of a race track 100 with indicia formed thereupon for illustrating the position of a particular vehicle on the race track 100 in real time. With reference to FIGS. 2-5, the oval type race track 100 includes a first straight 102, a first turn 104, a second turn 106, a second straight 108, a third turn 110 and a fourth turn 112. The first straight 102 is divided by a start/finish line 114. The race track 100 also includes a peripheral wall 116 and a peripheral infield shoulder 118.

Race track indicia preferably includes at least one of a first wall indicia strip 10 and a first shoulder indicia strip 12 formed around the outer and inner perimeters of the race track 100. At least one of a second wall indicia strip 14 and a second shoulder indicia strip 16 are formed starting at the beginning of the second turn 106 and ending at the start/finish line 114. At least one of a third wall indicia strip 18 and a third shoulder indicia strip 20 are formed starting at substantially the half way point of the second straight 108 and ending at the start/finish line 114. At least one of a fourth wall indicia strip 22 and a fourth shoulder indicia strap 24 are formed starting at the beginning of the fourth turn 112 and ending at the stop/finish line 114.

Figure 6:
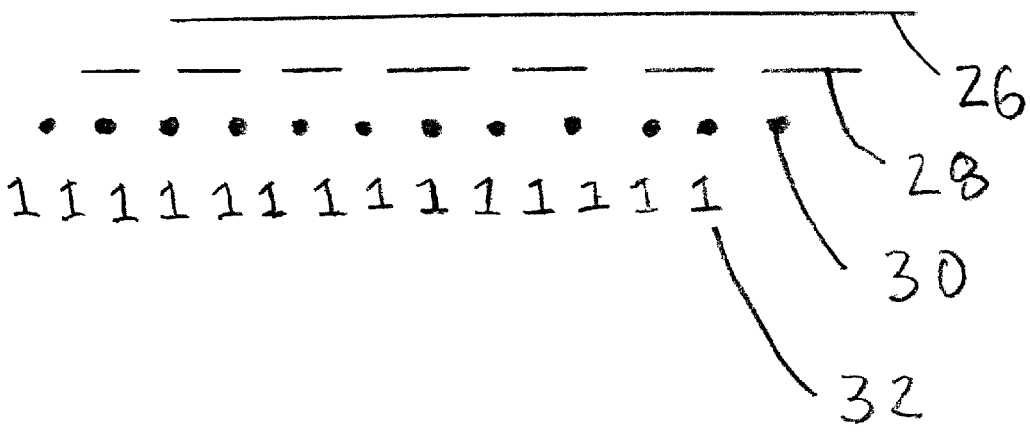
FIG. 6 is an indicia strip made from a plurality of dashes, a plurality of dots and a plurality of characters for a race track in accordance with the present invention.

With reference to FIG. 6, each indicia strip may be formed by a solid line 26, a dashed line 28, a plurality of dots 30, a plurality of characters 32, a plurality of objects (such as race cars) or any other suitable graphical representation. If the indicia strip is physically applied to the infield shoulder 118, the strip may have to be made discontinuous for pit entrances and exits. Each indicia strip may also be digitally or electronically added to a video feed of the race instead of physically applying the indicia strip to the wall 116 or the infield shoulder 118. Adding a digital line to a video feed is well known in the art and need not be explained in additional detail.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. Indicia for providing a visual clue of the position of a vehicle on a race track comprising:

a race track having at least a first straight, a first turn, a second turn, a second straight, a third turn, a fourth turn, a peripheral wall, a peripheral infield shoulder and a start/finish line is located on the first straight;

a first indicia strip is formed on at least one of the peripheral wall and the peripheral infield shoulder;

a second indicia strip being formed on at least one of the peripheral wall and the peripheral infield shoulder starting at substantially the beginning of the second turn and ending at the start/finish line;

a third indicia strip being formed on at least one of the peripheral wall and the peripheral infield shoulder starting at substantially the half way point of the second straight and ending at the start/finish line; and a fourth indicia strip being formed on at least one of the peripheral wall and the peripheral infield shoulder starting at substantially the beginning of the fourth turn and ending at the start/finish line.

2. The indicia for providing a visual clue of the position of a vehicle on a race track of claim 1 wherein:

said indicia strip being formed by a solid line.

3. The indicia for providing a visual clue of the position of a vehicle on a race track of claim 1 wherein:

said indicia strip being formed by a dashed line.

4. The indicia for providing a visual clue of the position of a vehicle on a race track of claim 1 wherein:

said indicia strip being formed by a plurality of characters.

5. The indicia for providing a visual clue of the position of a vehicle on a race track of claim 1 wherein:

said indicia strip being discontinuous.

6. The indicia for providing a visual clue of the position of a vehicle on a race track of claim 1 wherein:

said indicia strip being formed by a plurality of objects.

7. Indicia for providing a visual clue of the position of a vehicle on a race track comprising:

a race track having at least a first straight, a first turn, a second turn, a second straight, a third turn, a fourth turn, a peripheral wall, a peripheral infield shoulder and a start/finish line is located on the first straight;

a first indicia strip is physically applied on at least one of the peripheral wall and the peripheral infield shoulder;

a second indicia strip is physically applied on at least one of the peripheral wall and the peripheral infield shoulder starting at substantially the beginning of the second turn and ending at the start/finish line;

a third indicia strip is physically applied on at least one of the peripheral wall and the peripheral infield shoulder starting at substantially the half way point of the second straight and ending at the start/finish line; and a fourth indicia strip is physically applied on at least one of the peripheral wall and the peripheral infield shoulder starting at substantially the beginning of the fourth turn and ending at the start/finish line.

8. The indicia for providing a visual clue of the position of a vehicle on a race track of claim 7 wherein:

said indicia strip being formed by a solid line.

9. The indicia for providing a visual clue of the position of a vehicle on a race track of claim 7 wherein:

said indicia strip being formed by a dashed line.

10. The indicia for providing a visual clue of the position of a vehicle on a race track of claim 7 wherein:

said indicia strip being formed by a plurality of characters.

11. The indicia for providing a visual clue of the position of a vehicle on a race track of claim 7 wherein:

said indicia strip being discontinuous.

12. The indicia for providing a visual clue of the position of a vehicle on a race track of claim 7 wherein:

said indicia strip being formed by a plurality of objects.

13. Indicia for providing a visual clue of the position of a vehicle on a race track comprising:

a race track having at least a first straight, a first turn, a second turn, a second straight, a third turn, a fourth turn, a peripheral wall, a peripheral infield shoulder and a start/finish line is located on the first straight;

a first indicia strip is formed on at least one of the peripheral wall and the peripheral infield shoulder;

a second indicia strip being formed on at least one of the peripheral wall and the peripheral infield shoulder starting at substantially the beginning of the second turn and ending at the start/finish line;

a third indicia strip being formed on at least one of the peripheral wall and the peripheral infield shoulder starting at substantially the half way point of the second straight and ending at the start/finish line;

a fourth indicia strip being formed on at least one of the peripheral wall and the peripheral infield shoulder starting at substantially the beginning of the fourth turn and ending at the start/finish line; and said indicia strip is digitally or electronically applied to one of the peripheral wall and the peripheral infield shoulder during a broadcast of a race on the race track.

14. The indicia for providing a visual clue of the position of a vehicle on a race track of claim 13 wherein:

said indicia strip being formed by a solid line.

15. The indicia for providing a visual clue of the position of a vehicle on a race track of claim 13 wherein:

said indicia strip being formed by a dashed line.

16. The indicia for providing a visual clue of the position of a vehicle on a race track of claim 13 wherein:

said indicia strip being formed by a plurality of characters.

17. The indicia for providing a visual clue of the position of a vehicle on a race track of claim 13 wherein:

said indicia strip being discontinuous.

18. The indicia for providing a visual clue of the position of a vehicle on a race track of claim 13 wherein:

said indicia strip being formed by a plurality of objects.

* * * * *